US007011395B2

(12) United States Patent
Anderson et al.

(10) Patent No.: US 7,011,395 B2
(45) Date of Patent: Mar. 14, 2006

(54) PRINT HEAD ENERGY STORAGE

(75) Inventors: Frank Edward Anderson, Sadieville, KY (US); Darell Dean Cronch, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 24 days.

(21) Appl. No.: 10/656,860

(22) Filed: Sep. 5, 2003

(65) Prior Publication Data

US 2004/0263575 A1 Dec. 30, 2004

Related U.S. Application Data

(60) Provisional application No. 60/483,614, filed on Jun. 27, 2003.

(51) Int. Cl.
*B41J 2/05* (2006.01)
*B41J 29/38* (2006.01)

(52) U.S. Cl. ..... 347/57; 347/9

(58) Field of Classification Search ..... 347/20, 347/56–59, 61–65, 67, 14, 19, 9, 10
See application file for complete search history.

(56) References Cited

U.S. PATENT DOCUMENTS

| | | | | |
|---|---|---|---|---|
| 5,010,355 | A * | 4/1991 | Hawkins et al. | 347/64 |
| 5,835,115 | A * | 11/1998 | Kitazawa | 347/57 |
| 6,019,461 | A | 2/2000 | Yoshimura et al. | 347/86 |
| 6,099,101 | A | 8/2000 | Maurelli et al. | 347/7 |
| 6,126,273 | A | 10/2000 | Van Vooren et al. | 347/41 |
| 6,158,857 | A | 12/2000 | Elgee | 347/104 |
| 6,199,969 | B1 | 3/2001 | Haflinger et al. | 347/19 |
| 6,264,302 | B1 * | 7/2001 | Imanaka et al. | 347/19 |
| 6,273,544 | B1 | 8/2001 | Silverbrook | 347/54 |
| 6,278,470 | B1 | 8/2001 | Pollutro | 347/120 |
| 6,567,251 | B1 * | 5/2003 | Schulte et al. | 347/64 |

FOREIGN PATENT DOCUMENTS

| | | |
|---|---|---|
| JP | 60009775 | 1/1985 |
| JP | 62193853 | 8/1987 |
| JP | 5130054 | 5/1993 |
| JP | 11138803 | 5/1999 |

* cited by examiner

*Primary Examiner*—Juanita D. Stephens
(74) *Attorney, Agent, or Firm*—Dinsmore & Shohl, LLP

(57) ABSTRACT

The manner in which power is supplied to the firing elements of an ink jet printhead is improved by moving a power supply capacitor from the printer to the print head cartridge to improve the regulation of the supply of power to the firing elements of the print head cartridge. The capacitor can be attached to the tab circuit with solder or other wire bonding techniques. Placing the capacitor on the print head cartridge reduces the impedance between the capacitor and the print head, allows the capacitor to be matched to the print head cartridge firing requirements, allows remote voltage sensing at the print head, provides better voltage regulation at the print head and reduces the likelihood the printhead electronics will be damaged due to voltage spiking.

25 Claims, 3 Drawing Sheets

PRINT HEAD ENERGY STORAGE

CROSS-REFERENCE TO RELATED APPLICATIONS

Priority of our U.S. Provisional Patent Application Ser. No. 60/483,614, filed 27 Jun. 2003, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to printers. More particularly, the present invention relates to ink jet printers.

2. General Background of the Invention

The advent of CMOS print heads allowed the integration of print head drivers into the print head silicon. Firing nozzles require a large current in the print head resistor for a very short duration.

Typical ink jet printers have an energy distribution system similar to FIG. 1. Typically, there are five energy storage "capacitors" containing energy supplied to the printer. Print head firing, actual heating of the print head resistor, is very fast, thus the capacitors further from the print head provide little energy during the firing. The fifth capacitor located close to the print head supplies the current used to heat the print head resistor, which forms the ink drop to be ejected to the paper. The capacitor 5 on the carrier card is close to the print head but its location is still removed from the print head silicon. The current required by a print head is very large, often as much as 5-10 A instantaneously. Any capacitor Equivalent Series Resistance, ESR, or inductance, developed from trace width/spacing, causes voltage ringing at the print head silicon. This impedance restricts current available for print head firing and affects print head firing performance and as well can damage the print head electronics by creating overvoltage spikes. In addition, as the number of firing nozzles increases, the current increases. This current variation generates larger voltage and energy variations at the print head silicon. The goal of good energy distribution is to provide a constant voltage and current to each nozzle as the nozzle is fired. This goal is limited by the capacitor ESR and circuit board Lan length.

The following patent documents, and all patents and patent documents mentioned herein, are incorporated herein by reference: U.S. Pat. Nos. 6,278,470; 6,199,969; 6,158,857; 6,099,101; 6,019,461; Japanese patent document nos.: JP 11138803; JP 5130054; JP 62193853; and JP 60009775.

U.S. Pat. No. 6,199,969 to Halfinger et al. describes a method and system for detecting nonfunctional elements in an ink jet printer. A switching power supply is coupled to the print head to supply power to the print head. An output capacitor is coupled to the output of the switching power supply to store a DC voltage. An output shifting circuit is coupled to the switching power supply to shift the voltage level across the output capacitor between a low state and a high state. A test current discharging from the capacitor when an element of the print head is activated is then measured. The measured current is then compared with a reference current to determine if an element is nonfunctional.

The '969 patent discloses a capacitor coupled to the print head cartridge of an ink jet printer that switches between a high state and a low state.

U.S. Pat. No. 6,019,461 to Yoshimura describes an ink cartridge that has a memory device on which information about the ink cartridge is stored. A controller in the printer determines whether the attached cartridge is suitable for use with the printer by comparing the information in the memory with reference data stored in the printer. Alternatively, a capacitor having a capacitance value corresponding to the type of ink cartridge may be placed on the cartridge. The printer then determines the type of ink cartridge based upon the sensed capacitance of the capacitor on the print head cartridge.

Japanese Patent No. 11138803 to Kazuhiko discloses an ink jet type recording apparatus that uses a capacitor to reduce a change in print quality caused by the exchange of ink cartridges. When the ink cartridges are exchanged, a control signal is fed from a host computer in the recording apparatus to a printing preparatory signal-generating circuit. The signal-generating circuit changes a charging time of a capacitor and thereby changes the terminal voltage value of the capacitor at the charging time. The drive power supplied to the piezoelectric elements of the ink jet cartridge is then adjusted on the basis of the terminal voltage of the capacitor to limit changes in the print quality due to the exchange of the ink cartridges.

The '803 patent utilizes a capacitor to compensate for different ink cartridges installed in a printer. However, the '803 patent accomplishes this result by adjusting the charging time of the capacitor.

BRIEF SUMMARY OF THE INVENTION

An embodiment of the present invention comprises an ink jet printer having a firing capacitor on the print cartridge. This helps to reduce print head voltage swings due to the Lan length between the storage capacitor and the print head silicon. An embodiment of the present invention also includes the print cartridge.

The capacitor of the '969 patent is used to detect a nonfunctional heating element which is different from the function of the present invention. Furthermore, it is not clear from the disclosure of the '969 patent whether or not the capacitor is actually placed on the print head cartridge itself. The placement and configuration of the capacitor, capacitors, or capacitance means of the present invention reduces the impedance between the power supply capacitor and the heating elements of the ink jet print head. In addition, an embodiment of the present invention allows the power supply capacitor to be precisely matched to the print head cartridge.

The '461 patent discloses a print head cartridge having a capacitor positioned on the print head cartridge. However, the capacitor is used to identify the print head cartridge, not reduce the impedance between a power supply capacitor and the firing elements of an ink jet print head. Therefore, positioning and configuring a capacitor, capacitors, or capacitor means on an ink jet print head to improve regulation of the supply of power to the firing elements of an ink jet print head as recited in the present invention disclosure is believed to be patentable over the '461 patent.

The present invention includes a method and apparatus for improving the manner in which power is supplied to the firing elements of an ink jet printhead. More particularly, an embodiment of the present invention is directed toward a print head cartridge wherein a power supply capacitor is moved from the printer to the print head cartridge to improve the regulation of the supply of power to the firing elements of the print head cartridge. The capacitor can be attached to the tab circuit with solder or other wire bonding techniques. Placing the capacitor on the print head cartridge reduces the impedance between the capacitor and the print head, allows the capacitor to be matched to the print head cartridge firing requirements, allows remote voltage sensing at the print head, provides better voltage regulation at the print head and reduces the likelihood the printhead electronics will be damaged due to voltage spiking.

Unlike the '803 patent, the present invention positions a capacitor, capacitors, or capacitor means on the print head cartridge itself such that each individual ink cartridge has a capacitor, capacitors, or capacitor means specifically configured for use with that particular ink cartridge. In addition, the present invention positions the capacitor, capacitors, or capacitor means closer to the firing elements of the ink cartridge such that the impedance between the capacitor and the firing elements is reduced. Therefore, it is believed that positioning a power supply capacitor, capacitors, or capacitor means on an ink jet print head to improve power delivery to the firing elements of the ink jet print head as set forth herein is patentable over the '803 patent.

An embodiment of the present invention (e.g., as shown in FIG. 3) comprises an inkjet print head including a plurality of nozzles 122 for forming ink drops to be ejected onto print media 140 in an ink jet printer, a print head resistor 124 for firing the nozzles, and a capacitor 5 or a capacitor means on the ink jet print head for supplying current to heat the print head resistor to cause the nozzles to fire.

The capacitor means can include two or more capacitors, and can include a surface mount package. The capacitor or capacitor means can comprise layer ceramic or tantalum material. The capacitor or capacitor means can be around 2.0–3.2 mm wide by 1.25–2.5 mm long by 0.5 mm high. Preferably, the capacitor has a capacitance of about 22 $\mu$F.

An embodiment of the present invention comprises an inkjet print head cartridge comprising the inkjet print head. Another embodiment of the present invention comprises an ink jet printer comprising the inkjet print head cartridge.

An embodiment of the present invention comprises a method of improving power delivery to ink nozzle firing elements of an ink jet print head, comprising positioning an ink nozzle firing capacitor means on the ink jet print head. The capacitor means can include a capacitor or two or more capacitors. The capacitor means can include a surface mount package. The capacitor means can have a capacitance of about 22 $\mu$F.

The capacitor or capacitor means can comprise ceramic layered or tantalum material. The capacitor or capacitor means can be around 2.0–3.2 mm wide by 1.25–2.5 mm long by 0.5 mm high.

An embodiment of the present invention comprises installing the inkjet print head in an inkjet print head cartridge. Another embodiment of the present invention comprises installing the inkjet print head cartridge in an ink jet printer.

The print head can be, for example, a CMOS print head.

The novel print cartridges of the present invention can be used in various types of ink jet printers (such as Lexmark® Model Z51, Lexmark® Model Z31, and Lexmark® Model Z11, Lexmark® Photo Jetprinter 5770, or Kodak® PPM200).

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

An embodiment of the present invention includes a method of reducing the Lan impedance, thereby improving the energy distribution to the print head silicon during nozzle firing. This is accomplished by moving capacitor 5 from the carrier circuit board (as shown in FIG. 1) to the print cartridge (as shown in FIGS. 2 and 3).

Figure 1:
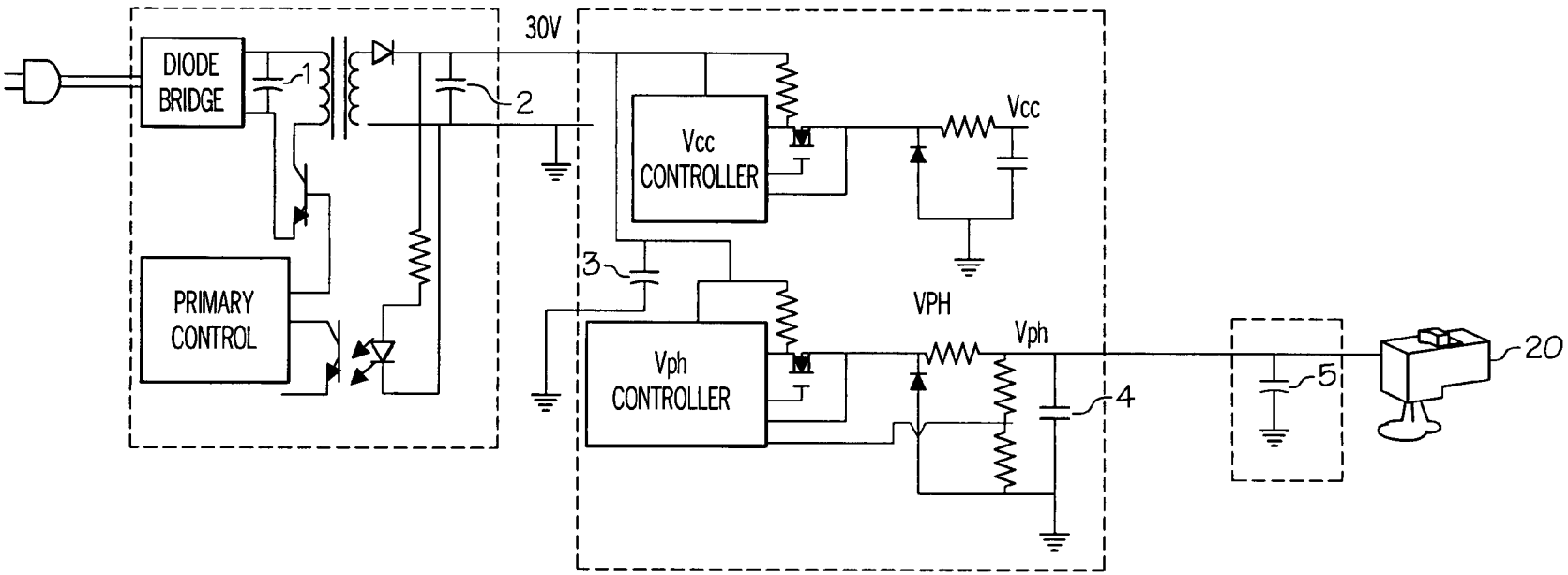
FIG. 1 (PRIOR ART)
FIG. 1 shows a typical prior art energy distribution system.
Figure 2:
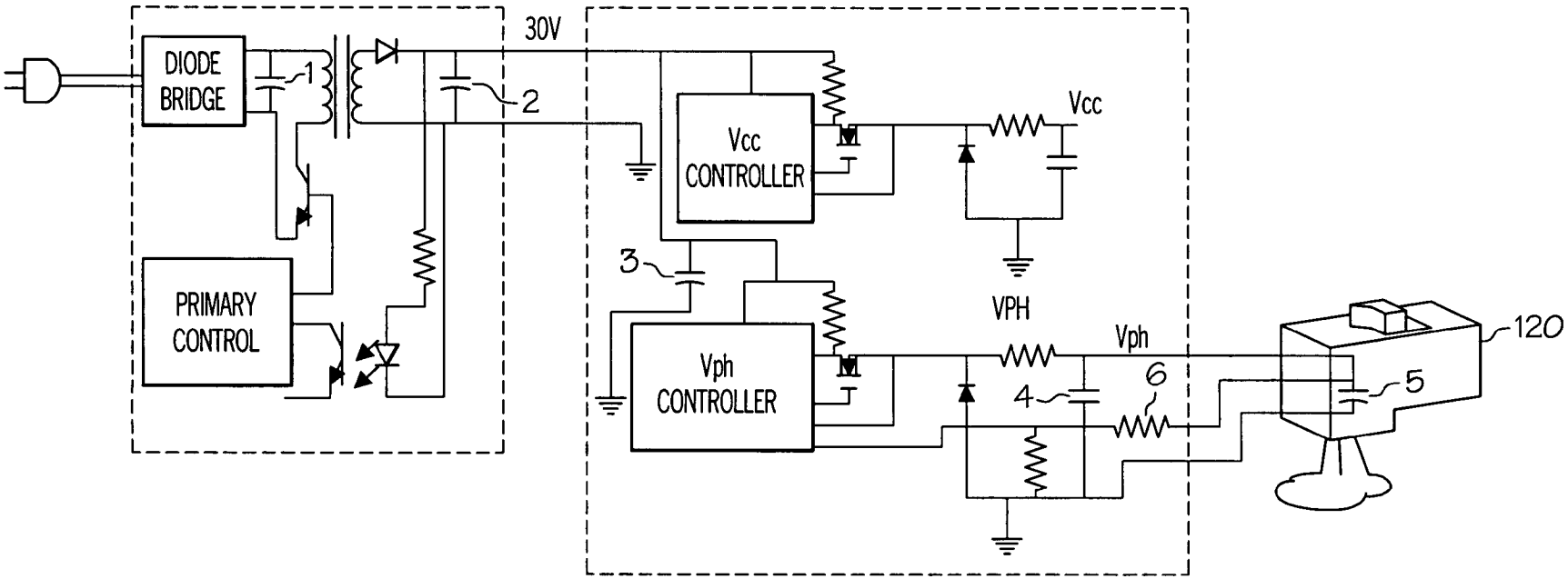
FIG. 2 shows an energy distribution system of an embodiment of the present invention.

In FIGS. 1 and 2, capacitors 1, 2, 3, and 5 are shown as polarized capacitors and capacitor 4 is shown as a non-polarized capacitor; capacitor 5 could be non-polarized.

FIG. 2 illustrates the movement of the capacitor 5 from the carrier card to the print cartridge. For capacitor 5 to be effective, remote voltage sensing (see sense line 6) improves the power supply loop gain, thus reducing the voltage drop during print head firing.

Figure 3:
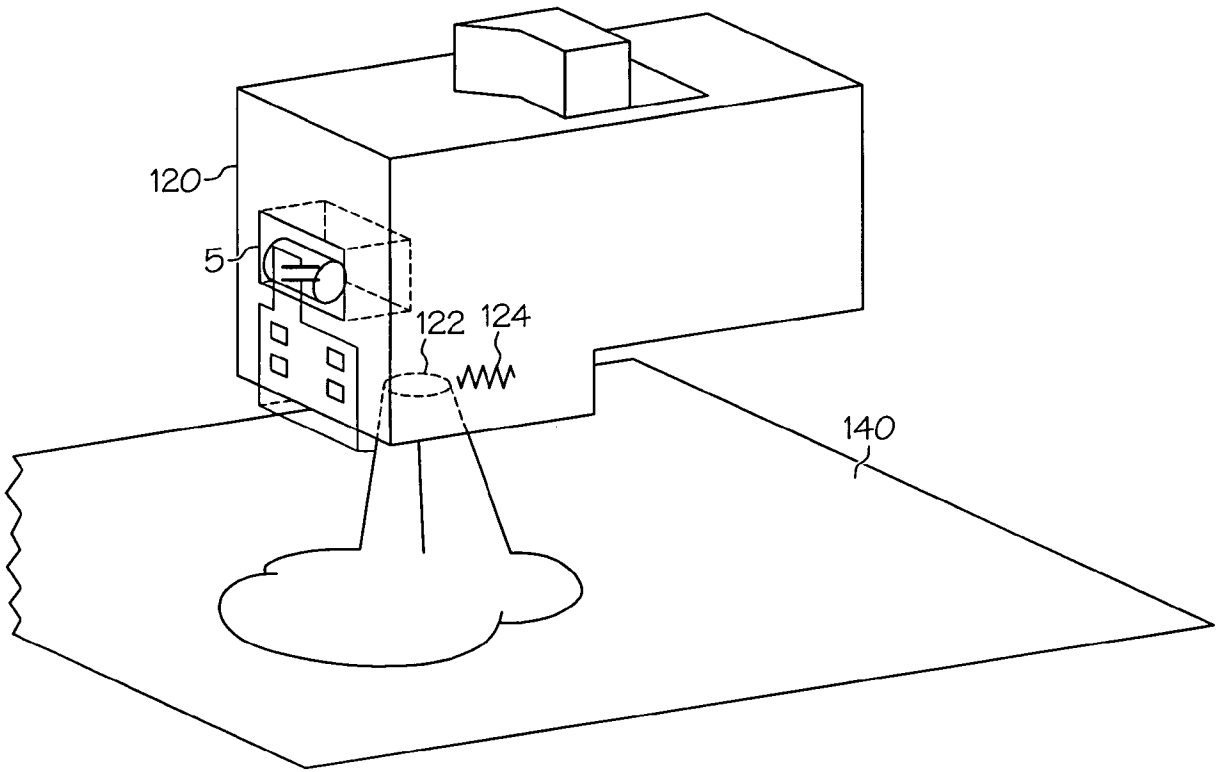
FIG. 3 shows an inkjet print head of an embodiment of the present invention.

Capacitor 5 could be housed in an indentation in the print head next to the tab circuit as shown in FIG. 3. This location for capacitor 5 would be optimized for each print head and one should keep in mind several system design considerations such as ink flow, print head size, capacitor size, etc, and manufacturing requirements. Capacitor 5 can be attached to the tab circuit with solder or other wire bonding techniques.

Capacitor 5 can consist of one capacitor or multiple capacitors with the proper capacitance and ESR to match the print head requirements. The physical movement of the capacitor becomes more important as the number of nozzles increase and with the migration from NMOS to CMOS print heads. In CMOS print heads the actual power driver is located in the print head, thus the location of the capacitor becomes more important. In present NMOS print heads an additional print head driver is required, thus capacitor 5 movement would not be beneficial.

The advantages of having capacitor 5 located in the print head include:

(1) Reduced impedance between the capacitor and print head;

(2) Match of capacitor to print head firing requirements.

(3) Allows remote voltage sensing at the print head, providing better voltage regulation at the capacitor.

(4) Lowers potential damage to print head electronics due to voltage spiking.

An embodiment of the present invention comprises inkjet cartridges 120 (FIG. 3) including capacitors 5 and inkjet printers 130 (FIG. 4) including these inkjet cartridges 120.

The value of the capacitor 5 can be the same as that of capacitors used in prior art systems (typically 5–50 $\mu$F, e.g. 22 $\mu$F).

The capacitor is preferably around 3.2 mm wide by 2.5 mm long by 0.5 mm high to around 2.0 mm wide by 1.25 mm long by 0.5 mm high. It can be around 3.2 mm wide by 1.6 mm long by 0.5 mm high.

Figure 4:
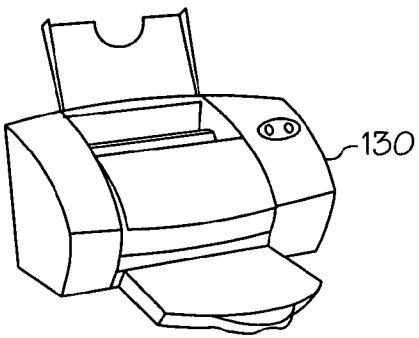
FIG. 4 shows an embodiment of the inkjet printer of the present invention.

FIG. 3 shows an inkjet print head 120 of an embodiment of the present invention. FIG. 4 shows an inkjet printer 130 including print head 120. Aside from the novel inkjet print heads 120, printer 130 can be the same as current Lexmark printers (such as Lexmark® Model Z51, Lexmark® Model Z31, and Lexmark® Model Z11, Lexmark® Photo Jetprinter 5770).

For elements of the present invention not shown herein, see one or more of the U.S. patents mentioned herein (e.g., Lexmark U.S. Pat. No. 6,404,834 for "Segmented spectrum clock generator apparatus and method for using same"; Lexmark U.S. Pat. No. 6,382,758 for "Printhead temperature monitoring system and method utilizing switched, multiple speed interrupts"; Lexmark U.S. Pat. No. 6,366,174 for "Method and apparatus for providing a clock generation circuit for digitally controlled frequency or spread spectrum clocking"; Lexmark U.S. Pat. No. 6,111,230 for "Method and apparatus for supplying AC power while meeting the European flicker and harmonic requirements"; Lexmark U.S. Pat. No. 6,099,101 for "Disabling refill and reuse of an ink jet print head"; Lexmark U.S. Pat. No. for "Ink jet printing apparatus having primary and secondary nozzles"), all of which are incorporated herein by reference.

Parts List:

The following is a list of parts and symbols used herein:

A/C alternating current
D/C direct current
ASIC application specific integrated circuit
V volts
Vcc carrier circuit voltage
Vph print head voltage
1 polarized capacitor
2 polarized capacitor
3 polarized capacitor
4 capacitor
5 capacitor (such as model no. 399-1301-1-ND commercially available from Digikey Corp. of Thief River Falls, Minn. 56701)
6 sense line
20 prior art inkjet print head
120 inkjet print head of an embodiment of the present invention
130 inkjet printer including print head 120

All measurements disclosed herein are at standard temperature and pressure, at sea level on Earth, unless indicated otherwise.

The foregoing embodiments are presented by way of example only; the scope of the present invention is to be limited only by the following claims.

What is claimed is:

1. Apparatus comprising:

an inkjet print head including:

a housing configured for transporting ink;

a plurality of nozzles for forming ink drops to be ejected onto print media in an ink jet printer;

a print head resistor for firing the nozzles;

a capacitor on the ink jet print head for supplying current to heat the print head resistor to cause the nozzles to fire, wherein the capacitor, resistor, and nozzles are secured to the housing.

2. The apparatus of claim 1, wherein the capacitor has a capacitance of about 22 $\mu$F.

3. Apparatus comprising:

an inkjet print head comprising silicon and including:

a plurality of nozzles for forming ink drops to be ejected onto print media in an ink jet printer;

a print head resistor for firing the nozzles; and a capacitor means located adjacent the ink jet print head silicon and secured therewith, wherein the capacitor means is configured for supplying current to heat the print head resistor to cause the nozzles to fire.

4. The apparatus of claim 3, wherein the capacitor means has a capacitance of about 22 $\mu$F.

5. The apparatus of claim 3, wherein the capacitor means includes at least one capacitor.

6. The apparatus of claim 1, wherein the capacitor comprises layer ceramic or tantalum material.

7. The apparatus of claim 1, wherein the capacitor is around 2.0–3.2 mm wide by 1.25–2.5 mm long by 0.5 mm high.

8. The apparatus of claim 1, wherein the capacitor is around 3.2 mm wide by 2.5 mm long by 0.5 mm high.

9. The apparatus of claim 1, wherein the capacitor is around 3.2 mm wide by 1.6 mm long by 0.5 mm high.

10. The apparatus of claim 1, wherein the capacitor is around 2.0 mm wide by 1.25 mm long by 0.5 mm high.

11. The apparatus of claim 1, further comprising an inkjet print head cartridge comprising the inkjet print head.

12. The apparatus of claim 11, further comprising an ink jet printer comprising the inkjet print head cartridge.

13. The apparatus of claim 1, wherein the print head is a CMOS print head.

14. A method of improving power delivery to ink nozzle firing elements of an ink jet print head, comprising positioning an ink nozzle firing capacitor means on the ink jet print head.

15. The method of claim 14, wherein the capacitor means includes at least one capacitor.

16. The method of claim 14, wherein the capacitor means has a capacitance of about 22 $\mu$F.

17. The method of claim 14, wherein the capacitor means comprise ceramic layered or tantalum material.

18. The method of claim 14, wherein the capacitor means is around 2.0–3.2 mm wide by 1.25–2.5 mm long by 0.5 mm high.

19. The method of claim 14, wherein the capacitor means is 3.2 mm wide by 2.5 mm long by 0.5 mm high.

20. The method of claim 14, wherein the capacitor means is 3.2 mm wide by 1.6 mm long by 0.5 mm high.

21. The method of claim 14, wherein the capacitor means is 2.0 mm wide by 1.25 mm long by 0.5 mm high.

22. The method of claim 14, further comprising installing the inkjet print head in an inkjet print head cartridge.

23. The method of claim 24, further comprising installing the inkjet print head cartridge in an ink jet printer.

24. The method of claim 14, wherein the print head is a CMOS print head.

25. A method of improving power delivery to ink nozzle firing elements of an ink jet print head, comprising positioning an ink nozzle firing capacitor means on the ink jet print head, wherein the capacitor means is around 2.0–3.2 mm wide by 1.25–2.5 mm long by 0.5 mm high.

* * * * *